US005309901A

United States Patent [19]

Beaussant

[11] Patent Number: 5,309,901

[45] Date of Patent: May 10, 1994

[54] INDIVIDUAL PROTECTIVE EQUIPMENT INCLUDING A PRESSURE SUIT AND A SELF-CONTAINED BREATHING APPARATUS

[75] Inventor: Raymond Beaussant, Bretigny, France

[73] Assignee: Intertechnique, France

[21] Appl. No.: 867,685

[22] PCT Filed: Nov. 25, 1991

[86] PCT No.: PCT/FR91/00932

§371 Date: Jul. 9, 1992

§102(e) Date Jul. 9, 1992

[87] PCT Pub. No.: WO92/09332

PCT Pub. Date: Jun. 11, 1992

[30] Foreign Application Priority Data

Nov. 27, 1990 [FR] France ..... 90 14812

[51] Int. Cl.[5] ..... A61G 10/00

[52] U.S. Cl. ..... 128/202.12; 128/201.22; 128/201.29

[58] Field of Search ..... 600/20; 128/201.21, 128/201.19, 201.24, 201.25, 201.29, 202.11, 202.12, 205.24, 201.22

[56] References Cited

U.S. PATENT DOCUMENTS

| | | | |
|---|---|---|---|
| 2,228,502 | 1/1941 | Boothby | 128/201.19 |
| 2,335,474 | 11/1943 | Beall | 128/202.11 |
| 2,404,020 | 7/1946 | Akerman | 128/202.11 |
| 2,881,758 | 4/1959 | Motsinger | 128/201.29 |
| 3,043,300 | 7/1962 | Flagg | 128/201.29 |
| 3,525,334 | 8/1970 | Braman | 128/201.29 |
| 3,528,414 | 9/1970 | Schueller | 2/2.1 A |
| 4,172,454 | 10/1979 | Warncke et al. | 128/201.29 |
| 4,458,680 | 7/1984 | Childers et al. | 128/201.29 |
| 4,534,344 | 8/1985 | Constance-Hughes | 128/201.25 |
| 4,807,614 | 2/1989 | van der Smissen et al. | 128/201.25 |
| 5,127,896 | 7/1992 | de Gaston | 128/202.11 |

FOREIGN PATENT DOCUMENTS

| | | |
|---|---|---|
| 649034 | 7/1937 | Fed. Rep. of Germany . |
| 1272657 | 8/1961 | France . |
| 2074456 | 11/1981 | United Kingdom . |

*Primary Examiner*—Edgar S. Burr
*Assistant Examiner*—Aaron J. Lewis
*Attorney, Agent, or Firm*—Larson and Taylor

[57] ABSTRACT

The individual equipment for use when taking action in a noxious atmosphere comprises a pressure suit having a flexible garment (10) and a helmet (12) provided with a transparent visor and including a self-contained breathing apparatus for supplying breathing gas from a gas supply. The face is separated from the garment by a neck gasket (16). The supply (24) is connected to a breathing circuit that opens out into the helmet via a regulator (48) to maintain the volume around the face at a pressure higher than that in the garment. The equipment also includes a face mask (52) having a valve for breathing in from the helmet and pipework for breathing out directly to the outside via rated non-return means.

12 Claims, 2 Drawing Sheets

INDIVIDUAL PROTECTIVE EQUIPMENT INCLUDING A PRESSURE SUIT AND A SELF-CONTAINED BREATHING APPARATUS

BACKGROUND OF THE INVENTION

The present invention relates to individual protective equipment against a hostile environment, in particular an atmosphere containing toxic or corrosive substances, the equipment comprising a pressure suit having a flexible garment and a helmet provided with a transparent visor, and having a self-contained breathing apparatus for supplying breathing gas from a gas supply.

Most existing equipments of this type do not take account of the protection hierarchy that it is desirable to achieve: the respiratory passages and the eyes must be given priority protection against toxic, corrosive, or irritant substances, in particular smoke when the equipment is intended for use by fire fighters engaging fires in industrial premises or on machines; then comes body protection. Exhaled gases containing $CO_2$ and water vapor dilute in the atmosphere surrounding the head and the body and may increase the $CO_2$ content thereof to a point that can become dangerous. Such equipment is vulnerable to tearing or puncturing of the garment which is much more likely to leak than the helmet.

The invention seeks in particular to provide protective equipment that ensures a high level of safety by implementing a hierarchy of parts of the body according to vulnerability thus making it possible, to some extent, to mitigate the consequences of a leak. It also seeks to slow down the increase in the concentration of water vapor and carbon dioxide gas around the body.

SUMMARY OF THE INVENTION

To this end, the invention provides, in particular, individual protective equipment of the type defined above, characterized in that the face is separated from the garment by a gasket, e.g. a face gasket or a neck gasket, in that the supply of breathing gas is connected to a breathing circuit opening out into the helmet via a regulator designed for maintaining the helmet at a higher pressure than the pressure in the garment, and in that the equipment further include a face mask having a valve for inhaling from the helmet and pipework for exhaling directly to the outside via rated non-return means. Because of this disposition, exhalation normally takes place directly to the surrounding environment outside the protective suit, thereby avoiding retaining the water vapor, the carbon dioxide, and the heat in the exhaled gas. In addition, the respiratory passages continue to be fed with sufficient quantities of breathing gas even in the event of a leak in the garment. The supply of gas is utilized well, since it is used for breathing only, whereas in prior equipment it was also required to deliver a flow sufficient for providing open-circuit ventilation.

In an advantageous embodiment, the rated non-return means comprise a first valve for maintaining a pressure inside the helmet that is greater than the maximum overpressure in the garment, which overpressure is fixed by other rated valves. An additional rated valve can then make a connection through the gasket to the inside of the garment from a portion of ducting extending between the outlet of the mask and the first rated valve that dumps to the outside. A non-return valve is advantageously placed at the outlet from the mask to increase NBC protection. By rating the various valves appropriately, exhalation takes place into the garment in the event of an incident reducing the pressure therein. The gas injected in this way escapes through any possible leak and by sweeping through the garment, it reduces contamination.

In individual protective equipment according to another aspect of the invention, the face is separated by the garment by an isolating gasket; the supply of breathing gas is connected to a breathing circuit that opens out into the helmet through a regulator designed to maintain the volume around the face at a pressure higher than the pressure in the garment; and the equipment also includes rated non-return means for exhalation to the outside and a rated valve for admitting exhaled air into the garment when the exhalation pressure rise relative to the garment pressure exceeds a determined value.

In addition to the open-circuit breathing circuit, the pressure suit advantageously includes a ventilation circuit that may be an open circuit or a closed circuit.

The supply of breathing gas may be constituted in conventional manner by a cylinder of compressed gas. It may also be constituted by a tank of liquefied gas.

The invention will be better understood on reading the following description of particular embodiments, given as non-limiting examples.

DETAILED DESCRIPTION OF THE PREFERRED EMBODIMENT

Figure 1:
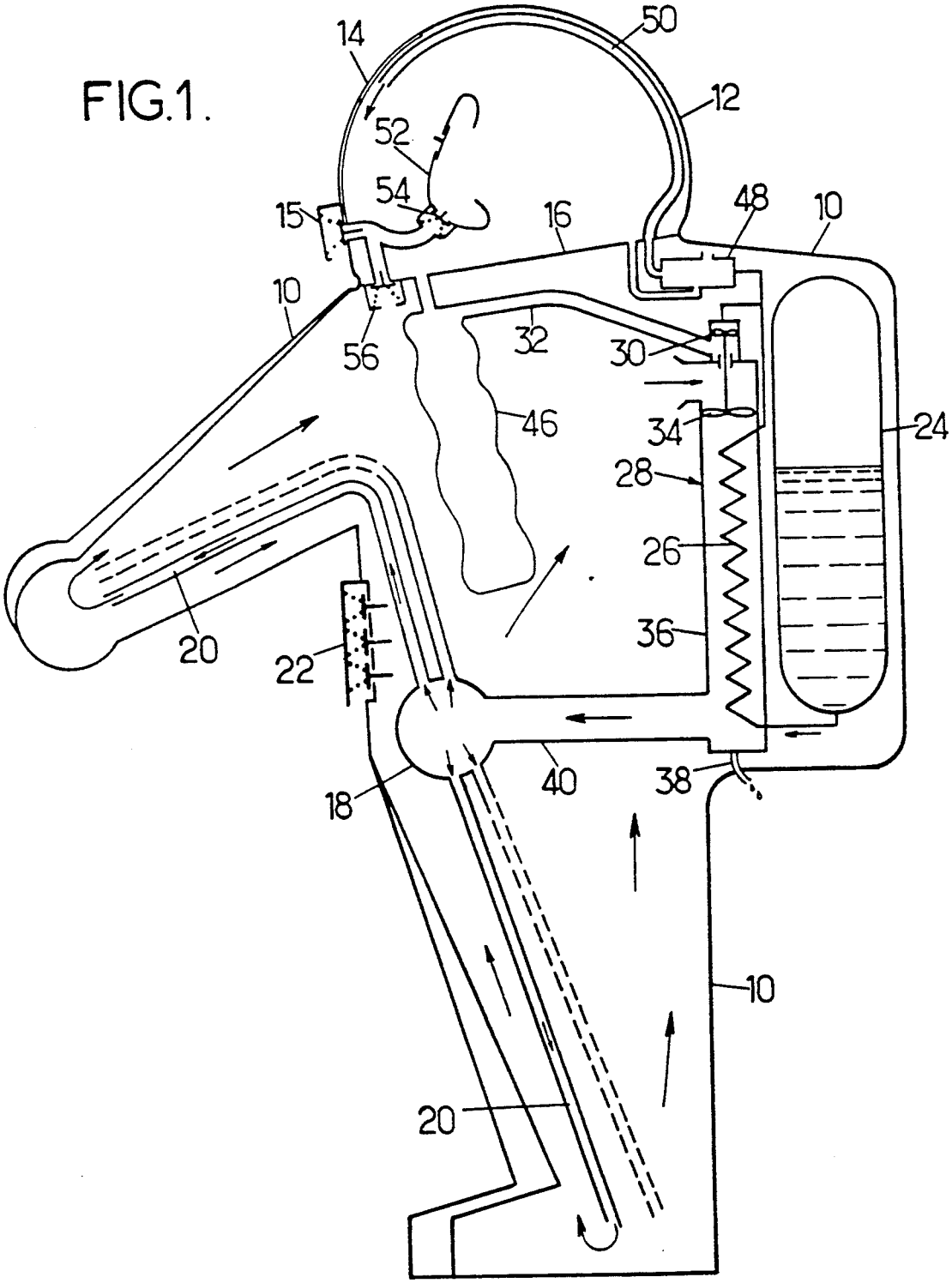
FIG. 1 is a diagram showing the general structure of individual protective equipment constituting a first embodiment of the invention.

The breathing equipment shown diagrammatically in FIG. 1 comprises a pressure suit having a garment 10 and a helmet 12 provided with a transparent visor 14. A neck gasket 16 that presses against the skin separates the space surrounding the head and filled with gas of a quality that is suitable for breathing from the space surrounding the remainder of the body.

The garment is advantageously fitted with a network of ducting enabling a flow of ventilation gas to be organized along the limbs and the torso. In the embodiment of FIG. 1, this network of ducting includes a manifold 18 between ducts 20 for feeding gas to the extremities of the limbs, with return flow taking place along the limbs towards the space surrounding the torso.

The garment 10 includes one or more rated valves 22 for maintaining a determined overpressure inside the suit. When the suit is used in atmosphere at normal atmospheric pressure, this overpressure is often about 2 millibars. It is sufficient to prevent the suit being invaded by toxic or corrosive substances from outside.

A supply of breathing gas, constituted in the example of FIG. 1 by a tank 24 of liquefied gas is installed in a pocket on the garment 10 or inside the garment. The tank is part of a converter whose general structure is similar to that of the converters commonly used at present in aviation. It is provided with a conventional expander (not shown) for regulating pressure to 5 bars, for example, and it feeds the coil 26 of a heat exchanger 28.

A fraction of the gas leaving the coil 26 feeds a rotary pneumatic motor 30 whose outlet is connected to a duct 32 which opens out into the helmet 12 via an economizer bag 46. The breathing gas that reaches the helmet does not therefore mix with the gas inside the garment. The motor 30 is coupled to a fan 34 for taking gas from inside the garment 10 and for causing it to flow through the heat exchanger 28, where said gas is cooled and dried prior to being delivered to the manifold 18. To do this, the heat exchanger 28 may include a gas-guiding case 36 provided at its bottom end with means for disposing of condensates, which means may be constituted merely by a tube 38 of small section.

The remainder of the breathing gas leaving the coil feeds a demand regulator 48 that feeds the helmet and that has reference pressure inlets inside the garment and inside the helmet. This regulator 48 is designed to maintain a determined overpressure (e.g. 2 millibars) inside the helmet 12 relative to inside the garment 10. It may, in particular, open out inside the helmet via a diffuser 50 for demisting the visor 14.

The equipment also includes a face mask 52 (i.e. a mask covering the mouth and the nose) provided with a valve for breathing in from the helmet and a non-return valve 52 for breathing out into pipework that opens out to the atmosphere via a rated valve 15. Another rated valve 56 connects the pipework to the garment 10 through the neck gasket 16. The valve 56 is rated to open at a pressure difference that is less than that which opens the valve 15, but greater than the pressure difference which is maintained in normal operation between the helmet and the garment by the regulator 48. In normal operation, the valve 56 is therefore closed.

If the pressure difference between the helmet and the garment is 2 millibars in normal operation, then the valves 15 and 56 may be rated at 4 millibars and at 3 millibars, respectively.

Because of this disposition, exhalation takes place directly to the outside of the protective suit in normal operation, thereby avoiding retention of exhaled water vapor and carbon dioxide.

In the event of an incident causing the pressure inside the garment to drop (a tear or a sudden movement), then the valves 22 close and no longer regulate the overpressure. The valve 56 opens during exhalation such that exhalation takes place into the garment. The gases injected in this way escape by the possible leak, thereby sweeping through the garment and thus reducing contamination. This degraded mode of operation complies with the hierarchy of protection that should be satisfied (respiratory passages, eyes, then body).

Figure 2:
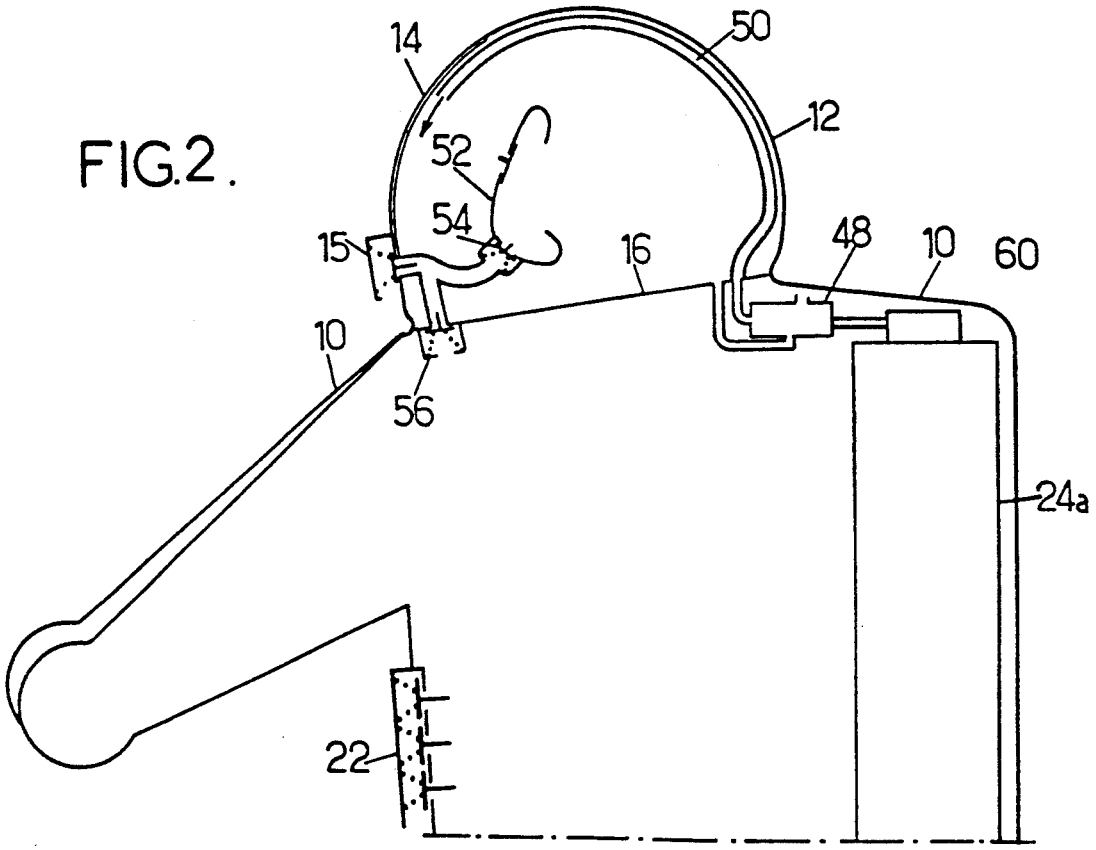
FIG. 2 is similar to FIG. 1 showing another embodiment.

In the variant embodiment shown in FIG. 2 in which items corresponding to items in FIG. 1 are designated by the same reference numerals, the supply of breathing gas is constituted by a compressed gas cylinder 24*a* fitted with an expander 60. Under such circumstances, the ventilation circuit may have any of the structures that are presently known and used. This embodiment likewise ensures the desirable hierarchy of protection. By exhaling directly to the atmosphere, it avoids $CO_2$ accumulating and the risk of water vapor condensing inside the helmet or inside the garment. It dumps the heat contained in the exhalation gases at 37° C. directly to the atmosphere.

Figure 3:
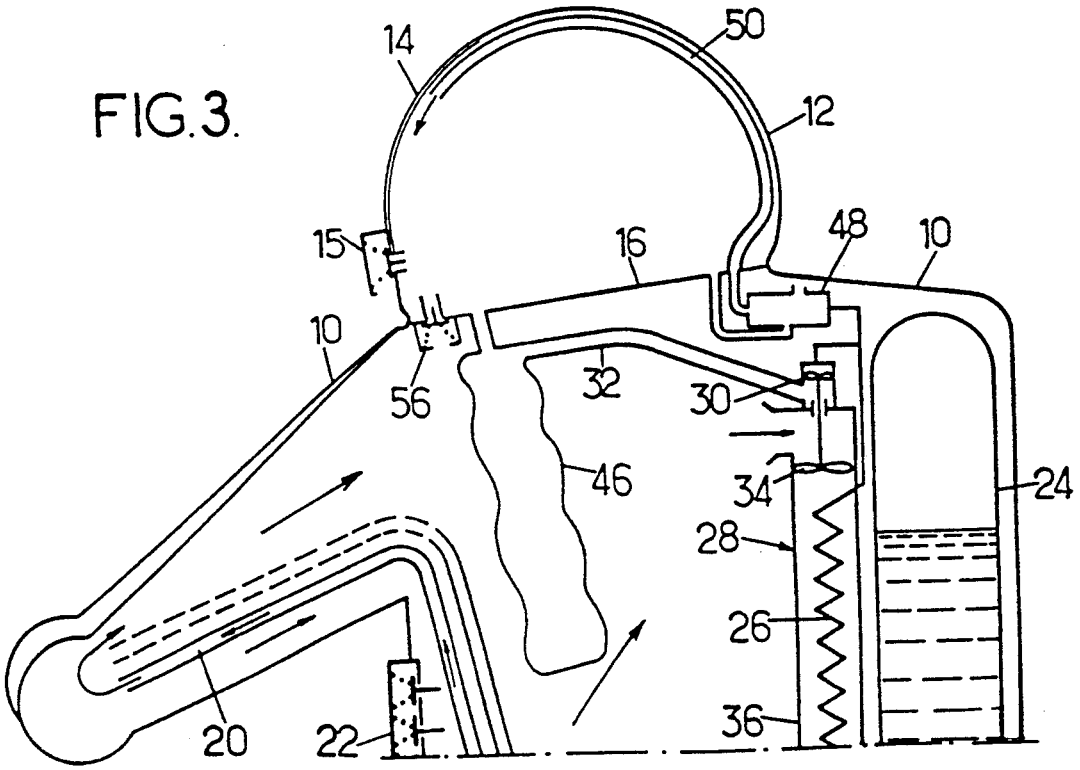
FIG. 3 is similar to FIG. 2 and shows a simplified embodiment.

A simplified embodiment shown in FIG. 3 does not include a face mask. However, the diffuser 50 and the duct 32 are disposed so as to feed fresh gas from the supply into the face region and to oppose dispersion of exhaled gas so as to ensure that it escapes via the rated valve 15 for exhaling to the surroundings. This disposition makes it possible to slow down the rise in $CO_2$ content. The staggering of the values at which the valves 15, 22, and 56 are rated (e.g. opening at overpressures of 4, 2, and 3 millibars) is the same as in the embodiments of FIGS. 1 and 2.

I claim:

1. Individual protective equipment comprising:

a protective suit having a flexible garment, a helmet provided with a transparent visor surrounding the head, sealing means separating a volume of gas around a wearer's face within the helmet from an additional volume defined by the garment around a body of the wearer, and an oro-nasal mask provided with a valve for inhaling from said volume of gas around the face within the helmet and means for exhaling directly to ambient, said means including rate non-return valve means; and a self-contained breathing apparatus having a supply of gas connected to a breathing circuit opening out into said helmet, said breathing circuit including a regulator maintaining said volume of gas around the face at an overpressure relative to the pressure in said additional volume.

2. Equipment according to claim 1, further comprising additional valves for limiting the overpressure inside the garment to a maximum value, wherein said rate non-return valve means are arranged for maintaining an overpressure inside volume of gas said around the face that is greater than said predetermined value.

3. Equipment according to claim 2, characterized in that it includes a second rated valve (56) connecting the garment (10) through the gasket (16) to a portion of the ducting between the rated valve means (15) opening out to the outside.

4. Equipment according to claim 2, characterized in that it includes a non-return valve (54) placed on the mask (52) at the inlet to the ducting.

5. Equipment according to claim 4, characterized in that the second rated valve (56) is rated to open at a pressure difference which is lower than that which the first valve (15) opens but greater than the pressure difference which is maintained in normal operation between the helmet and the garment by the demand regulator (48).

6. Equipment according to claim 1, wherein said regulator includes reference pressure inlets inside the garment and inside the helmet so as to maintain a determined overpressure inside the volume of gas around the face relative to the garment.

7. Equipment according to claim 6, wherein said determined overpressure is 2 millibars.

8. Equipment according to claim 1, wherein said gas supply is a tank of liquefied breathing gas, the breathing circuit is fed from the tank via a primary circuit of a heat exchanger and the breathing circuit includes a pneumatic motor of a fan for causing air for ventilating the garment to flow through a closed circuit that includes a secondary circuit of the heat exchanger.

9. Equipment according to claim 8, having means for separating the flow of breathing gas coming from the primary circuit of the heat exchanger into a first fraction which is passed through the pneumatic motor and a second portion directed to the volume of gas around the wearer's face via said regulator for matching the breathing of the wearer.

10. Equipment according to claim 1, characterized by an economizer bag (46) placed inside the garment and interposed on the breathing gas circuit.

11. Equipment according to claim 1, wherein said sealing means consist of a neck seal.

12. Individual protective equipment comprising:

a protective suit having a flexible garment, a helmet provided with a transparent visor sealing means separating a volume of gas around a wearer's face within the helmet from an additional volume defined by the protective suit; and a self-contained breathing apparatus including: a breathing gas storage supply connected to a breathing circuit opening out into the helmet and including a regulator designed for maintaining the volume around the face at an overpressure relative to the pressure in the garment; rated non-return valve means for exhalation to the outside; and a rated valve for admitting exhaled air into the garment when an exhalation overpressure relative to the garment exceeds a determined value.

* * * * *